US007980831B2

(12) United States Patent
Miyake et al.

(10) Patent No.: US 7,980,831 B2
(45) Date of Patent: Jul. 19, 2011

(54) OSCILLATING TYPE COMPRESSOR

(75) Inventors: Shingo Miyake, Yokohama (JP); Yoshie Tsujimi, Kawasaki (JP); Takahisa Hirasawa, Fujisawa (JP)

(73) Assignee: Hitachi, Ltd., Tokyo (JP)

( * ) Notice: Subject to any disclaimer, the term of this patent is extended or adjusted under 35 U.S.C. 154(b) by 1085 days.

(21) Appl. No.: 11/806,016

(22) Filed: May 29, 2007

(65) Prior Publication Data

US 2007/0280833 A1 Dec. 6, 2007

(30) Foreign Application Priority Data

May 31, 2006 (JP) ..... 2006-152658

(51) Int. Cl.
*F04B 17/03* (2006.01)

(52) U.S. Cl. ..... 417/326; 417/12; 417/53; 417/415; 318/281

(58) Field of Classification Search ..... 417/315, 417/326, 53, 12, 44.1, 415; 92/140; 310/68 B, 310/68 E, 68 R, 69; 318/281, 283, 739
See application file for complete search history.

(56) References Cited

U.S. PATENT DOCUMENTS 2,997,862 A * 8/1961 Dineen ..... 62/403
6,217,287 B1 * 4/2001 Monk et al. ..... 417/45

FOREIGN PATENT DOCUMENTS

JP 2003-161260 6/2003

* cited by examiner

*Primary Examiner* — William H Rodriguez
*Assistant Examiner* — Philip Stimpert
(74) *Attorney, Agent, or Firm* — Wenderoth, Lind & Ponack, L.L.P.

(57) ABSTRACT

An oscillating type piston is connected to an output shaft of an electric motor through a crankshaft. The piston is provided with a lip ring that slidingly contacts a cylinder. The motor is rotated forward and reversely by using a control circuit. Thus, different regions of the piston are subjected to a load during forward rotation of the motor and during reverse rotation thereof. Accordingly, wear of the lip ring can be distributed to different regions thereof.

6 Claims, 19 Drawing Sheets

OSCILLATING TYPE COMPRESSOR

BACKGROUND OF THE INVENTION

The present invention relates to an oscillating type compressor suitable for use to compress a fluid, for example, air.

As an oilless enclosed reciprocating compressor for compressing air or other fluid, there is commonly known an oscillating type compressor having an oscillating type piston reciprocating in a cylinder while oscillating (for example, see Japanese Patent Application Publication No. 2003-161260). In such an oscillating type compressor, a piston is connected to a crankshaft, and the crankshaft is driven to rotate by using a motor. The piston has a lip ring attached to the outer periphery thereof to serve as a seal member.

In the above-described oscillating type compressor according to the related art, when the piston reciprocates in the cylinder while oscillating, not the whole periphery of the lip portion of the lip ring but only a part thereof that is located at the load side during the compression stroke is strongly pressed against the inner peripheral surface of the cylinder and thus becomes worn.

That is, during the compression stroke where the piston moves from the bottom dead center to the top dead center, the pressure in the compression chamber becomes high, so that the piston and the lip ring are subjected to a large load. Further, of two regions of the lip ring at two opposite ends in the oscillation direction of the piston, one region that is displaced to a larger extent during the compression stroke until the top dead center is reached serves as a load side region that is subjected to a larger load. Accordingly, partial wear occurs at the load side region of the lip ring. During a continuous operation of the compressor, in particular, the cylinder and the lip ring are heated to a high temperature by heat of compression from the compression chamber, frictional heat and so forth. Therefore, the wear of the lip ring is accelerated.

Consequently, the lip ring may become incapable of sealing due to the wear at the above-described one part thereof although the rest of the lip ring has become worn to only about 30 percents of the thickness thereof. Moreover, the lip ring is fixedly fitted to the disk portion of the piston to prevent leakage of air from the compression chamber. Therefore, when the oscillating type compressor is operated, wear occurs concentratedly at one part of the lip portion that is located in the oscillation direction of the piston. Accordingly, the service life of the lip ring is unfavorably dependent on the wear at the one part thereof.

SUMMARY OF THE INVENTION

The present invention has been made in view of the above-described problems with the related art. Accordingly, an object of the present invention is to provide an oscillating type compressor adapted to distribute the wear of a seal member evenly to thereby enable extension of the service life thereof.

The present invention provides an oscillating type compressor including a cylinder and a piston connected to an output shaft of a motor to reciprocate in the cylinder while oscillating and to define a compression chamber in the cylinder. An annular seal member is provided on the outer periphery of the piston to seal between the piston and the cylinder. The oscillating type compressor further includes a controller that controls drive of the motor. The controller is switchable between an operation mode in which the output shaft of the motor is rotated forward to perform a compressing operation, and an operation mode in which the output shaft of the motor is rotated reversely to perform a compressing operation.

The controller may be adapted to switch over the direction of rotation of the output shaft of the motor when it is restarted after being stopped.

The controller may be adapted to switch over the direction of rotation of the output shaft of the motor when it has been driven continuously for a predetermined period of time.

The controller may be adapted to pause for a predetermined period of time before switching over the direction of rotation of the output shaft of the motor.

In addition, the present invention provides a method of controlling an oscillating type compressor having a cylinder, a piston connected to an output shaft of a motor to reciprocate in the cylinder while oscillating and to define a compression chamber in the cylinder, and an annular seal member provided on the outer periphery of the piston to seal between the piston and the cylinder. The method includes a step of detecting a pressure in a tank storing compressed air discharged from the oscillating type compressor, and a judging step of judging whether or not the pressure in the tank is lower than a predetermined maximum value. The method further includes a step of storing, if the pressure in the tank is judged to be not lower than the maximum value at the judging step, the direction of rotation of the motor, and stopping the motor to stop the compressing operation of the compressor, and a step of driving, if the pressure in the tank is judged to be lower than a predetermined minimum value at the judging step, the motor to rotate in a direction opposite to the stored direction of rotation of the motor.

The method may further include a second judging step of judging whether or not a length of time that the motor has been driven continuously in the same direction of rotation has exceeded a predetermined period of time, and a step of storing, if it is judged at the second judging step that the predetermined period of time has been exceeded, the present direction of rotation of the motor and thereafter switching over the direction of rotation of the motor.

In addition, the present invention provides a method of controlling an oscillating type compressor having a cylinder, a piston connected to an output shaft of a motor to reciprocate in the cylinder while oscillating and to define a compression chamber in the cylinder, and an annular seal member provided on the outer periphery of the piston to seal between the piston and the cylinder. The method includes a judging step of judging whether or not a length of time that the motor has been driven continuously in the same direction of rotation has exceeded a predetermined period of time, and a step of storing, if it is judged at the judging step that the predetermined period of time has been exceeded, the present direction of rotation of the motor and thereafter switching over the direction of rotation of the motor.

DETAILED DESCRIPTION OF THE PREFERRED EMBODIMENTS

Oscillating type compressors according to embodiments of the present invention will be described below in detail with reference to the accompanying drawings.

Figure 1:
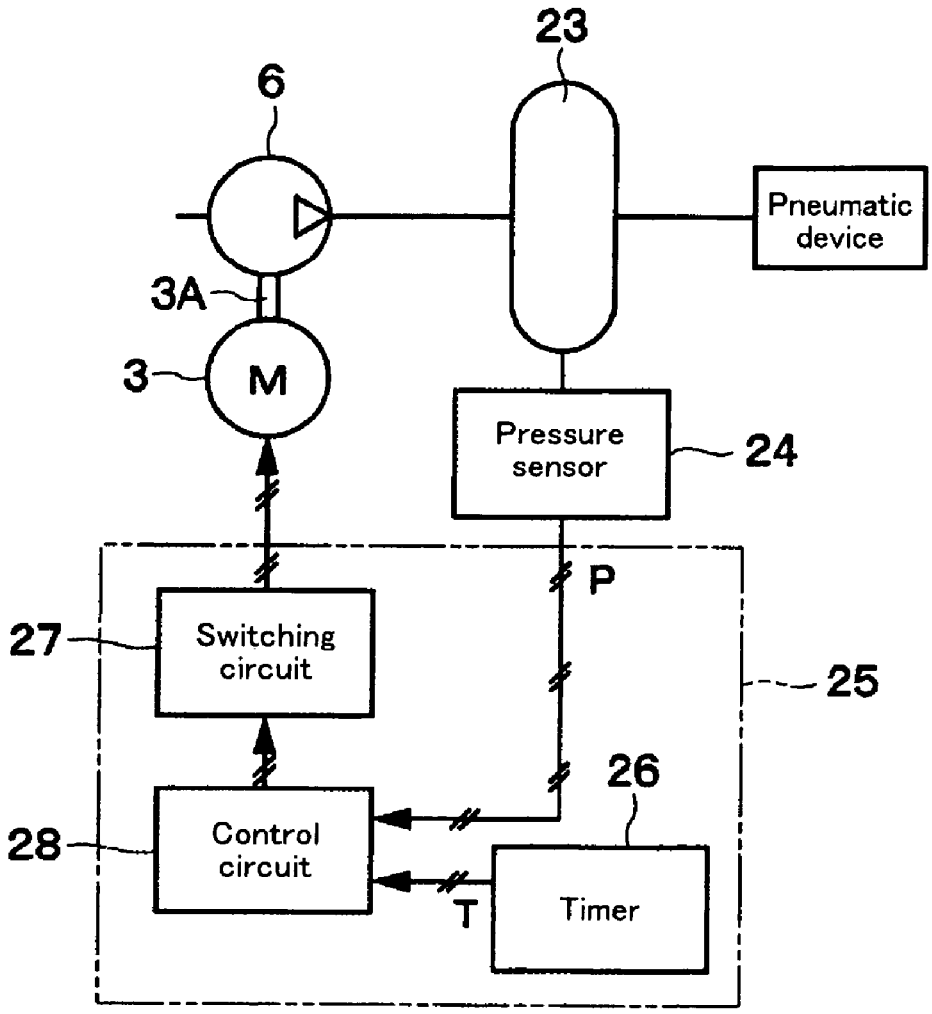
FIG. 1 is a general block diagram showing an oscillating type compressor according to a first embodiment of the present invention.
Figure 2:
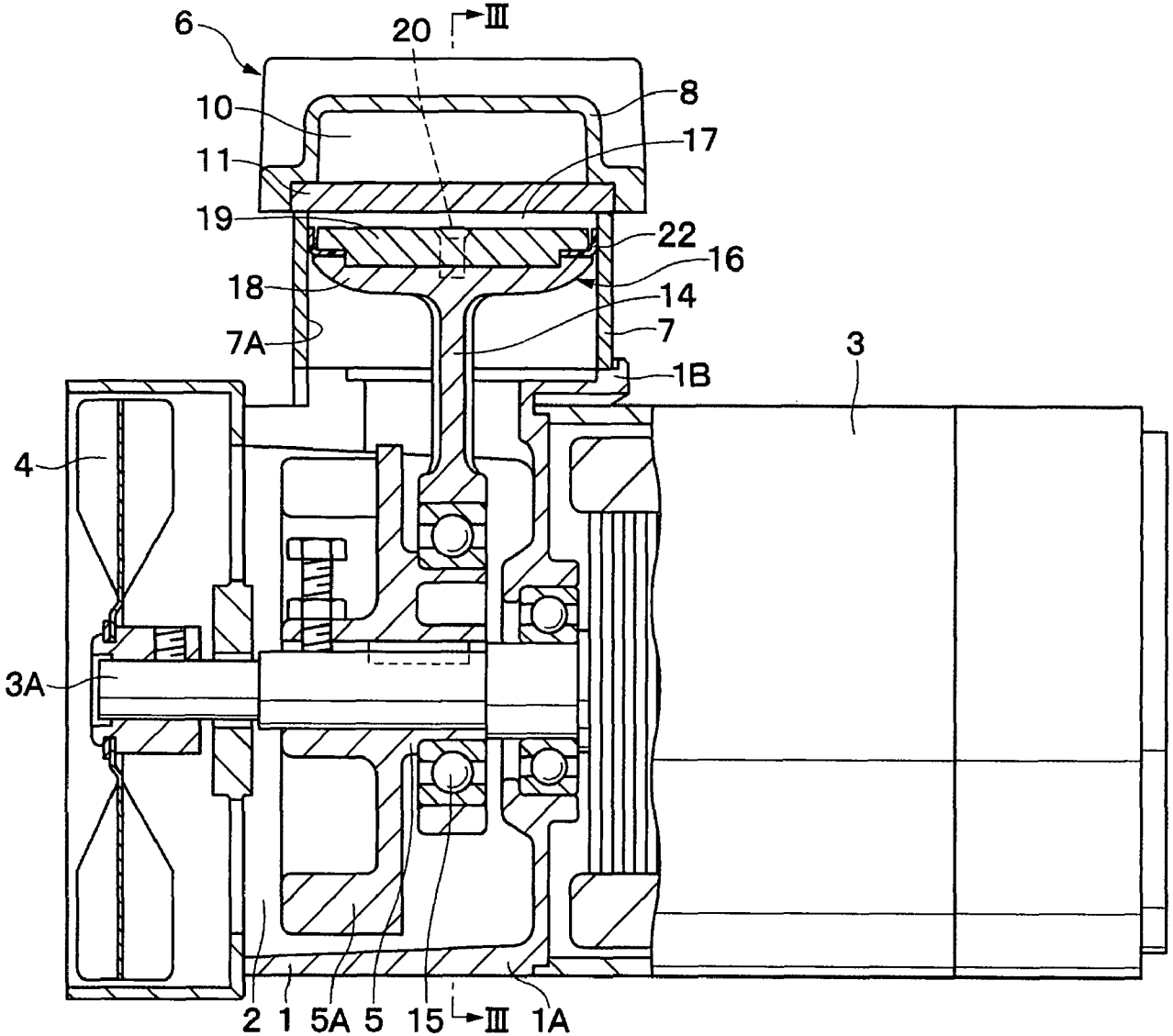
FIG. 2 is a vertical sectional view showing an electric motor and a compressing section in FIG. 1.
Figure 3:
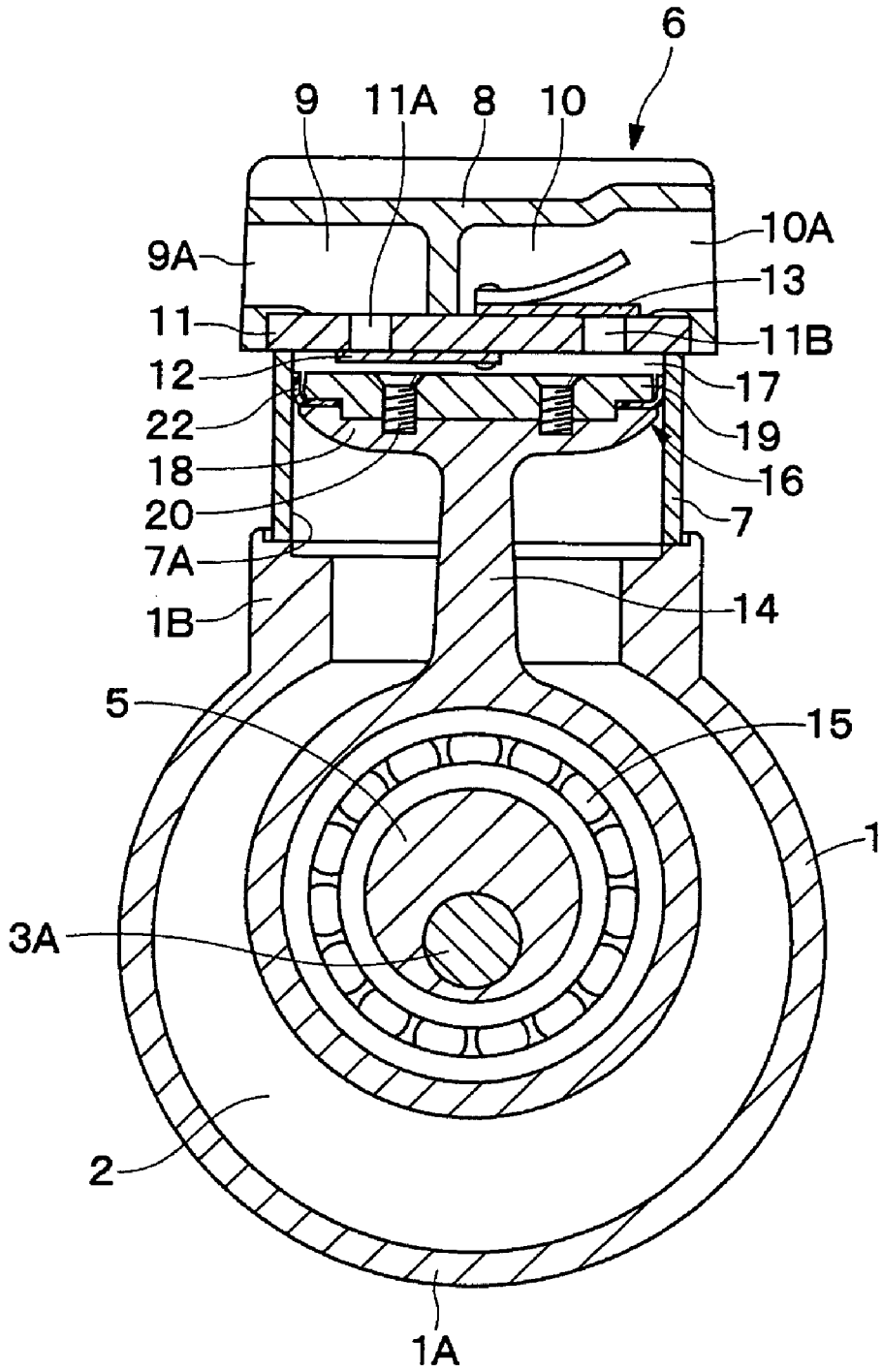
FIG. 3 is a sectional view of the compressing section as seen in the direction of the arrow III-III in FIG. 2.

FIGS. 1 to 15 show an oscillating type compressor according to a first embodiment of the present invention. In FIG. 2, the oscillating type compressor has a crankcase 1 that defines a crank chamber 2 therein. As shown in FIGS. 2 and 3, the crankcase 1 substantially comprises a circular cylindrical casing portion 1A having an axis placed horizontally and a cylinder mounting seat 1B provided at the upper side of the cylindrical casing portion 1A.

An electric motor 3 is attached to the crankcase 1. The motor 3 is, for example, a three-phase induction motor, and has an output shaft 3A capable of forward and reverse rotation. A cooling fan 4 is secured to the distal end of the output shaft 3A of the motor 3. Thus, the cooling fan 4 rotates together with the output shaft 3A to supply cooling air toward a cylinder 7 (described later), etc through the crank chamber 2. The drive of the motor 3 is controlled by using a control circuit 28 (described later).

A crankshaft 5 is provided in the crank chamber 2 of the crankcase 1. The crankshaft 5 is rotatably supported in the crankcase 1. The crankshaft 5 has a balance weight 5A integrally provided thereon. The crankshaft 5 is eccentrically connected to the output shaft 3A of the motor 3 and driven to rotate together with the output shaft 3A.

A compressing section 6 is driven by the motor 3. The compressing section 6 comprises a cylinder 7, a cylinder head 8, a piston 16, etc., which will be described later. The compressing section 6 sucks in outside air and discharges compressed air.

A circular cylindrical cylinder 7 is mounted on the cylinder mounting seat 1B of the crankcase 1. The cylinder 7 opens at the proximal end thereof into the crank chamber 2 and has an inner peripheral surface 7A serving as a sliding surface for a lip ring 22 (described later). A cylinder head 8 is mounted on the distal end of the cylinder 7. The interior of the cylinder head 8 is, as shown in FIG. 3, divided to define a suction chamber 9 into which outside air is sucked through a suction opening 9A, and a discharge chamber 10 from which compressed air is discharged through a discharge opening 10A.

A valve seat plate 11 is held between the cylinder 7 and the cylinder head 8. The valve seat plate 11 is formed with a suction hole 11A communicating between the suction chamber 9 and a compression chamber 17 (described later) and a discharge hole 11B communicating between the discharge chamber 10 and the compression chamber 17. The valve seat plate 11 is equipped with a suction valve 12, which is a reed valve, and a discharge valve 13, which is also a reed valve. The proximal ends of the suction valve 12 and the discharge valve 13 are fixed ends that are screwed to the valve seat plate 11. The distal ends of the suction valve 12 and the discharge valve 13 are free ends that open or close the suction hole 11A and the discharge hole 11B, respectively.

The suction valve 12 opens during a suction stroke where the piston 16 (described later) moves from the top dead center to the bottom dead center, and closes in a compression stroke where the piston 16 moves from the bottom dead center to the top dead center. In contrast, the discharge valve 13 opens during the compression stroke where the piston 16 moves from the bottom dead center to the top dead center, and closes during the suction stroke where the piston 16 moves from the top dead center to the bottom dead center.

A piston rod 14 is rotatably connected at the proximal end thereof to the crankshaft 5 through a bearing 15. The piston rod 14 extends at the distal end thereof into the cylinder 7 and causes the piston 16 provided on the distal end thereof to reciprocate in the cylinder 7 while oscillating.

The oscillating type piston 16 is slidably provided in the cylinder 7. As shown in FIG. 3, the piston 16 reciprocates in the cylinder 7 while oscillating. The piston 16 defines the compression chamber 17 in the cylinder 7 between itself and the valve seat plate 11. The piston 16 comprises a piston body 18, a retainer 19, etc. (described later).

The piston body 18, which has a disk shape, forms a lower-end portion of the piston 16. The piston body 18 has the distal end of the piston rod 14 integrally attached to the center of the lower side thereof.

The retainer 19 is provided on the upper side of the piston body 18. The retainer 19 is detachably secured to the piston body 18 with bolts 20 to enable a lip ring 22 (described later) to be fitted to and removed from the piston 16.

A ring fitting groove 21 (see FIG. 13) is provided on the outer periphery of the piston 16. The ring fitting groove 21 is formed as an annular narrow recess-shaped groove that opens radially outward between the piston body 18 and the retainer 19.

A lip ring 22 serves as a seal member provided on the outer periphery of the piston 16. The lip ring 22 seals between the piston 16 and the cylinder 7 to prevent leakage of air (pressure) from the compression chamber 17. The lip ring 22 is formed, for example, from a resin material (e.g. a fluororesin material) excellent in wear resistance, flexibility and self-lubricating properties to improve slidability with respect to the cylinder 7. The lip ring 22 is formed with an L-shaped cross section.

The lip ring 22 comprises a fitting portion 22A formed as a flat annular plate at the radially inner side thereof and a lip portion 22B that is bent from the radially outer end of the fitting portion 22A upward toward the compression chamber 17 and expanded in a cup shape so as to slidingly contact the inner peripheral surface 7A of the cylinder 7. The fitting portion 22A of the lip ring 22 is held between the piston body 18 and the retainer 19. Thus, the lip ring 22 is fixedly mounted with the fitting portion 22A fitted in the ring fitting groove 21 of the piston 16.

23 designates a tank 23 storing compressed air. The tank 23 is connected to the discharge opening 10A of the cylinder head 8 to store compressed air discharged from the discharge opening 10A. The tank 23 is, as shown in FIG. 1, connected to an external pneumatic device, e.g. a nail driver, through an output port (not shown) to supply compressed air to the pneumatic device. The tank 23 is provided with a relief valve (not shown) as a safety device.

The tank 23 is provided with a pressure sensor 24 to measure the pressure in the tank 23. The pressure sensor 24 outputs a signal representing the detected pressure to a control circuit 28 (described later).

A power supply section 25 is provided in connection with the motor 3. The power supply section 25 is provided with a manual switch (not shown) for selectively driving or stopping the motor 3. The power supply section 25 further has a timer 26 for measuring time, a switching circuit 27 for switching over the direction of rotation of the motor 3; and a control circuit 28. Further, the power supply section 25 is provided with a temperature sensor (not shown) as a safety device to detect an excessively high temperature of the motor 3.

The timer 26 measures, for example, a length of time that the motor 3 has been driven continuously in the same direction of rotation, and outputs the measured time to the control circuit 28 (described later).

Figure 4:
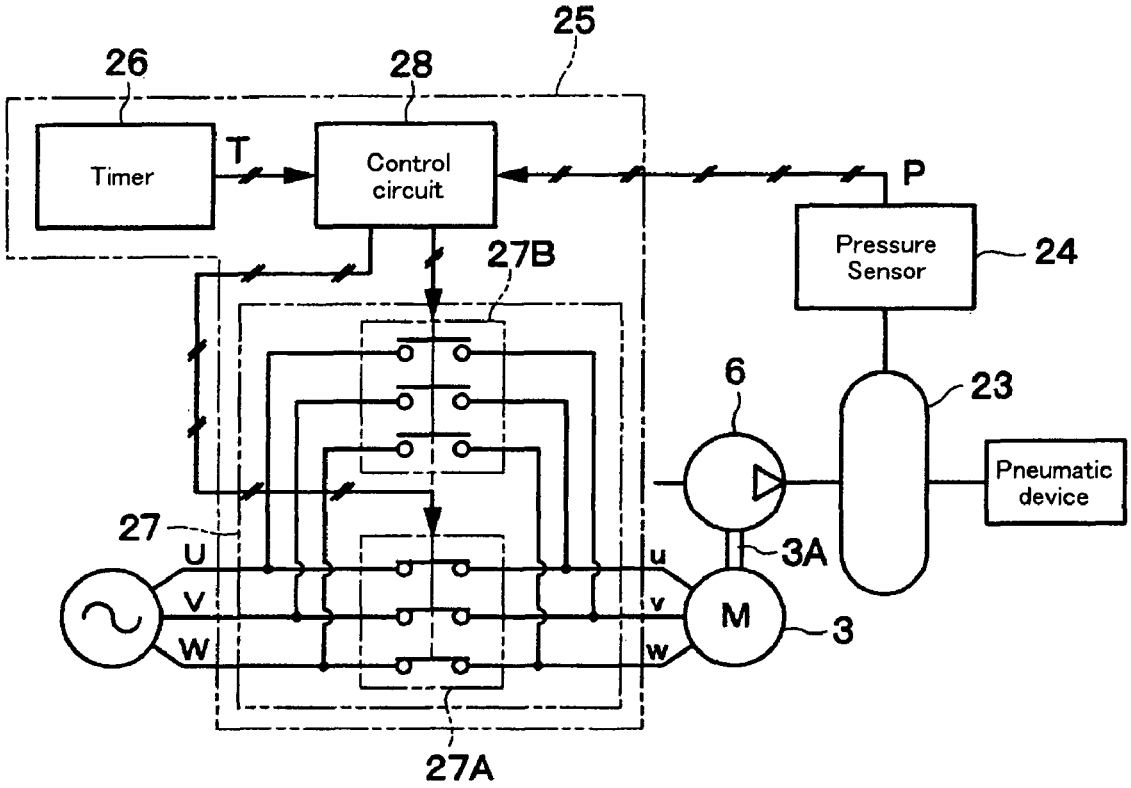
FIG. 4 is a circuit diagram showing a switching circuit in FIG. 1.

The switching circuit 27 for switching over the direction of rotation of the motor 3 to an opposite direction comprises, as shown in FIG. 4, a forward rotation relay 27A for forwardly rotating the output shaft 3A, and a reverse rotation relay 27B for reversely rotating the output shaft 3A, for example. The forward rotation relay 27A connects the U, V and W phases of an external three-phase AC power source to the u, v and w phases, respectively, of the motor 3. The reverse rotation relay 27B is connected in parallel to the forward rotation relay 27A. The reverse rotation relay 27B changes over the U and V phases, for example, of the external three-phase AC power source so that the U, V and W phases of the three-phase AC power source are connected to the v, u and w phases, respectively, of the motor 3. Thus, when turning ON the forward rotation relay 27A, the switching circuit 27 turns OFF the reverse rotation relay 27B to rotate the motor 3 in the forward direction. When turning ON the reverse rotation relay 27B, the switching circuit 27 turns OFF the forward rotation relay 27A to rotate the motor 3 in the reverse direction.

The control circuit 28 serves as a controller that controls the drive of the motor 3. The control circuit 28 comprises a microcomputer, for example, which has previously stored therein a program that controls the drive of the motor 3, and items of data such as a maximum value $P_{max}$ and a minimum value $P_{min}$ of pressure P, and a predetermined time $T_0$ used as a threshold during a continuous operation, which will be described later. The control circuit 28 is connected with the pressure sensor 24, the timer 26 and the switching circuit 27. The control circuit 28 controls the drive and stop of the motor 3 according to the below-described program on the basis of a detected signal from the pressure sensor 24 and also switches over the direction of rotation of the motor 3 by using the timer 26, the switching circuit 27, and so forth. Thus, the control circuit 28 switches between an operation mode in which the motor 3 is rotated forward to cause the compressing section 6 to perform a compressing operation, and an operation mode in which the motor 3 is rotated reversely to cause the compressing section 6 to perform a compressing operation.

Figure 6:
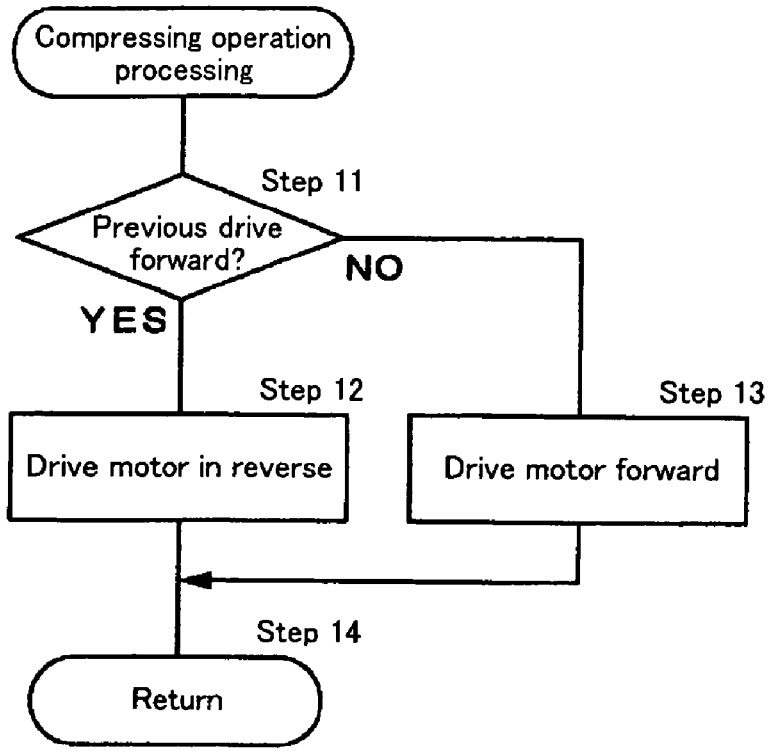
FIG. 6 is a flowchart showing compressing operation processing in FIG. 5.
Figure 7:
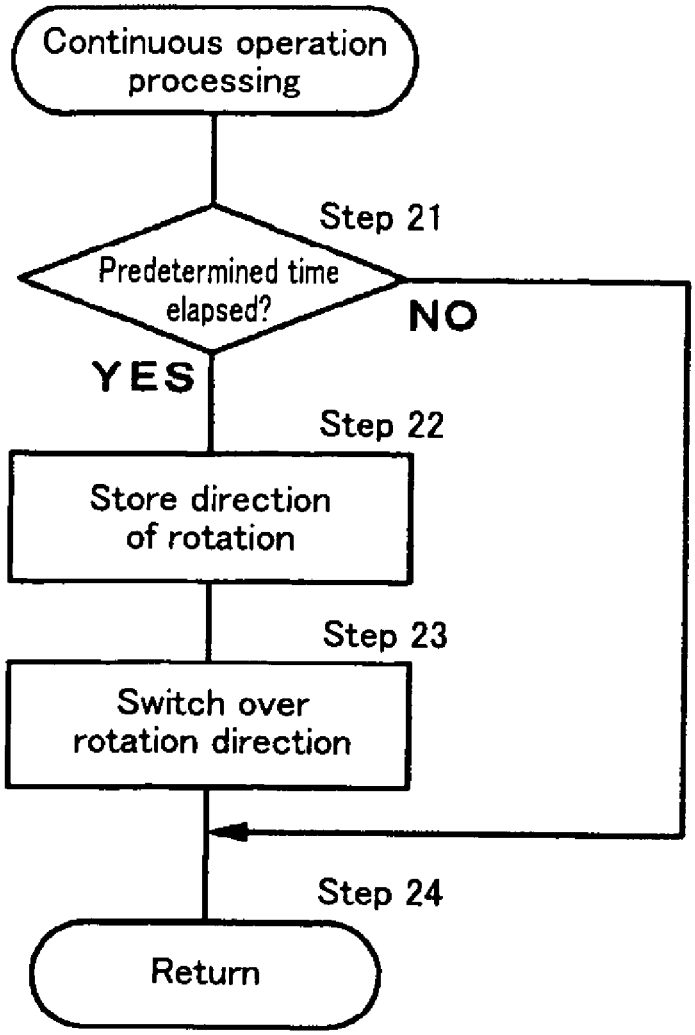
FIG. 7 is a flowchart showing continuous operation processing in FIG. 5.

Next, the control of the compressor operation by the control circuit 28 will be explained with reference to FIGS. 5 to 7.

Figure 5:
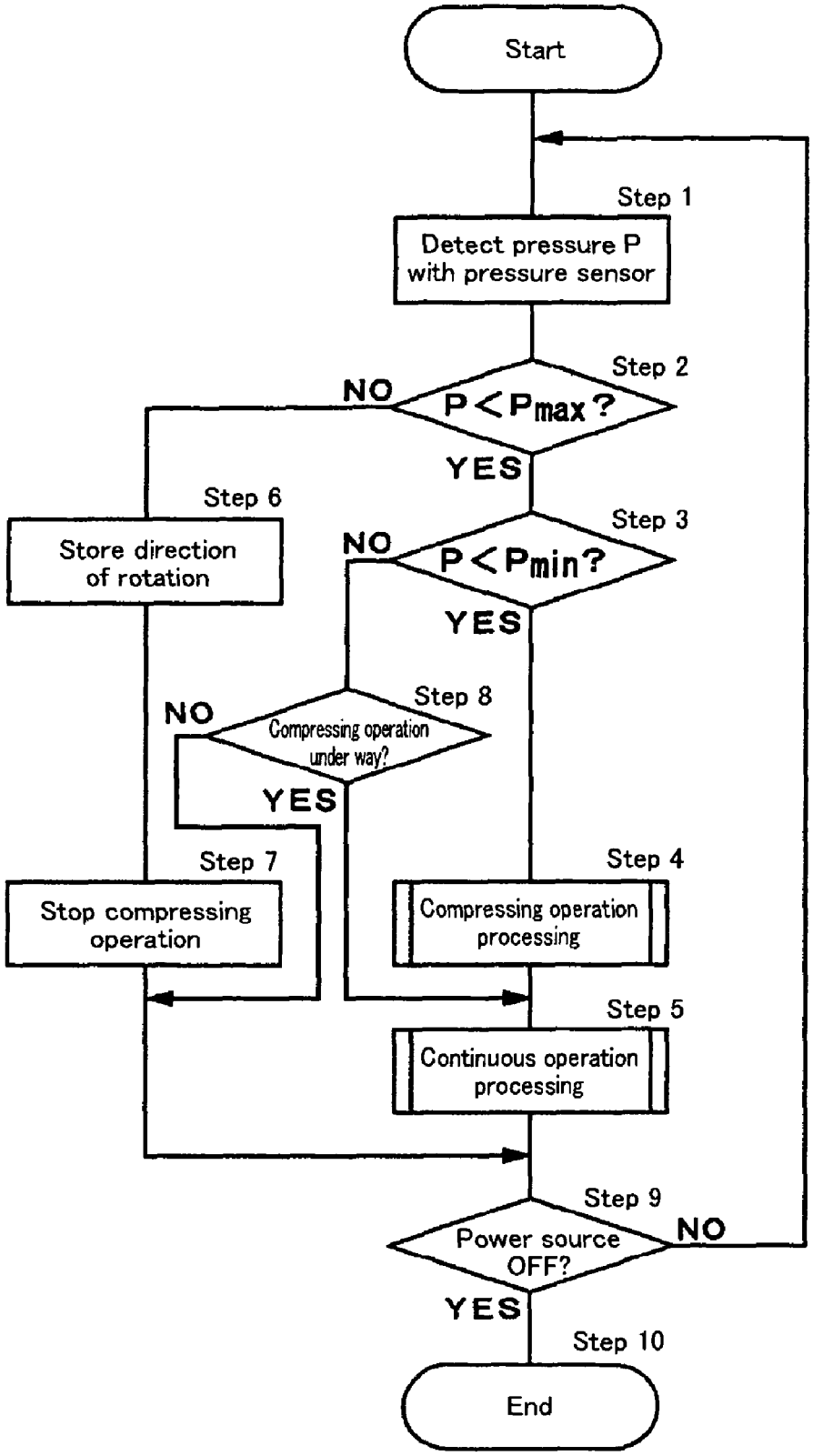
FIG. 5 is a flowchart showing pressure-based operation control of the oscillating type compressor.

In FIG. 5, pressure-based operation control is performed as follows. The pressure P in the tank 23 is constantly monitored. When the pressure P has reached a predetermined maximum value $P_{max}$, the compressing operation is stopped, and when the pressure P has lowered to a predetermined minimum value $P_{min}$, the compressing operation is resumed.

In the pressure-based operation control, at step 1, a pressure P is detected by using a detected signal from the pressure sensor 24. At step 2, it is judged whether or not the detected pressure P is lower than a predetermined maximum value $P_{max}$ (e.g. $P_{max}$=0.7 MPa).

If "YES" is the answer at step 2, then it is judged at step 3 whether or not the pressure P is lower than a predetermined minimum value $P_{min}$ (e.g. $P_{min}$=0.5 MPa). If "YES" is the answer at step 3, compressing operation processing is performed at step 4, and continuous operation processing is performed at step 5, as will be described later. Thus, the motor 3 rotates forward or reversely at a predetermined rotational speed $N_0$ (e.g. $N_0$=1450 rpm), for example, and the compressing section 6 performs a compressing operation with the motor 3 rotated forward or reversely.

If "NO" is the answer at step 2, it means that the pressure P is not lower than the maximum value $P_{max}$. Therefore, if the motor 3 is being driven, the direction of rotation of the motor 3 is stored at step 6. Thereafter, the power supply to the motor 3 is stopped to stop the compressing operation of the compressor.

If "NO" is the answer at step 3, it means that the pressure P is between the minimum value $P_{min}$ and the maximum value $P_{max}$. Then, it is judged at step 8 whether or not a compressing operation is under way. If "YES" is the answer at step 8, the compressor is allowed to continue the compressing operation at step 5. If "NO" is the answer at step 8, the compressor continues to be held in the inoperative (stop) state.

Thus, in the pressure-based operation control, the compressor is intermittently operated or stopped, whereby the pressure P in the tank 23 is controlled so as to fall between the minimum value $P_{min}$ and the maximum value $P_{max}$. Processing through steps 1 to 8 is repeated until the power source of the compressor is turned OFF at step 9.

Next, the compressing operation processing shown at step 4 in FIG. 5 will be explained with reference to FIG. 6.

When the compressing operation processing is started, it is judged at step 11 whether or not the direction of rotation of the motor 3 during the previous drive is forward. If "YES" is the answer at step 11, it means that the motor 3 had been rotating forward before it stopped. Accordingly, the motor 3 is reversed at step 12. Specifically, the control circuit 28 turns ON the reverse rotation relay 27B of the switching circuit 27 while turning OFF the forward rotation relay 27A. Consequently, the motor 3 is driven to rotate the output shaft 3A in the reverse direction.

If "NO" is the answer at step 11, it means that the motor 3 had been rotating reversely before it stopped. Therefore, the motor 3 is rotated forward at step 13. Specifically, the control circuit 28 turns ON the forward rotation relay 27A of the switching circuit 27 while turning OFF the reverse rotation relay 27B. Consequently, the motor 3 is driven to rotate the output shaft 3A in the forward direction.

After the motor 3 has been rotated in the reverse or forward direction at step 12 or 13, the process proceeds to step 14 to return.

Next, the continuous operation processing shown at step 5 in FIG. 5 will be explained with reference to FIG. 7.

When the continuous operation processing is started, it is judged at step 21 whether or not the length of time that the motor 3 has been driven continuously in the same direction of rotation has exceeded a predetermined period of time $T_0$ (e.g. $T_0$=5 minutes).

Specifically, the control circuit 28 resets the timer 26 when switching over the motor 3 from an inoperative (stop) state to an operative (drive) state and when switching between the forward and reverse rotations of the motor 3. Thus, the control circuit 28 detects a continuous drive time T of the motor 3 in the same direction of rotation by using a signal from the timer 26.

If "YES" is the answer at step 21, it means that the continuous drive time T is in excess of the predetermined period of time $T_0$ as a threshold. Accordingly, the present direction of rotation of the motor 3 is stored at step 22. Thereafter, the rotation direction of the motor 3 is switched over at step 23.

When switching over the direction of rotation of the motor 3, the control circuit 28 temporarily turns OFF both the forward and reverse rotation relays 27A and 27B of the switching circuit 27 to prevent short-circuiting between the U and V phases and troubles due to counter electromotive force. After stopping the compressor for a predetermined period of time (e.g. several seconds), the control circuit 28 turns ON only either of the forward and reverse rotation relays 27A and 27B that was not ON during the previous drive. Consequently, the motor 3 rotates reversely if it rotated forward during the previous drive. The motor 3 rotates forward if it rotated reversely during the previous drive.

If "NO" is the answer at step 21, it means that the continuous drive time T is not in excess of the predetermined time $T_0$. Accordingly, the motor 3 continues to be driven in the present direction of rotation, and the process returns at step 24.

The oscillating type compressor according to this embodiment has the above-described structure and operates as explained below with reference to FIGS. 8 to 15.

Figure 8:
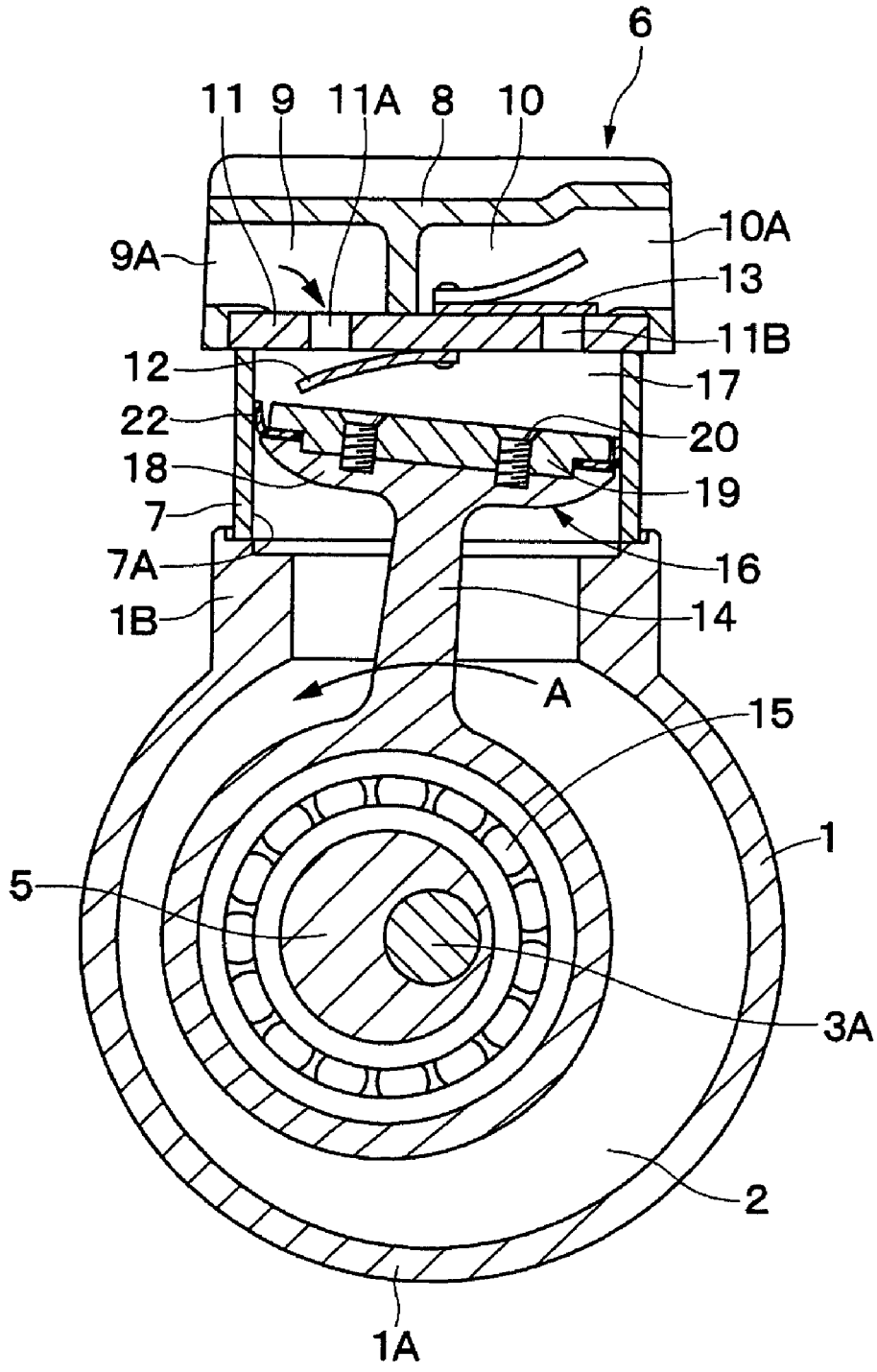
FIG. 8 is a sectional view similar to FIG. 3, showing the suction stroke of the compressing section when the motor is rotated forward.

When the motor 3 is driven to rotate, as shown in FIG. 8, the piston 16 reciprocates in the cylinder 7 while oscillating. Thus, the compressor performs a compressing operation in which it repeats a suction stroke where the compressor sucks air from the suction chamber 9 into the compression chamber 17, and a compression stroke where the compressor compresses the air in the compression chamber 17 and discharges the compressed air into the discharge chamber 10. The compressed air is supplied into the external tank 23.

Figure 9:
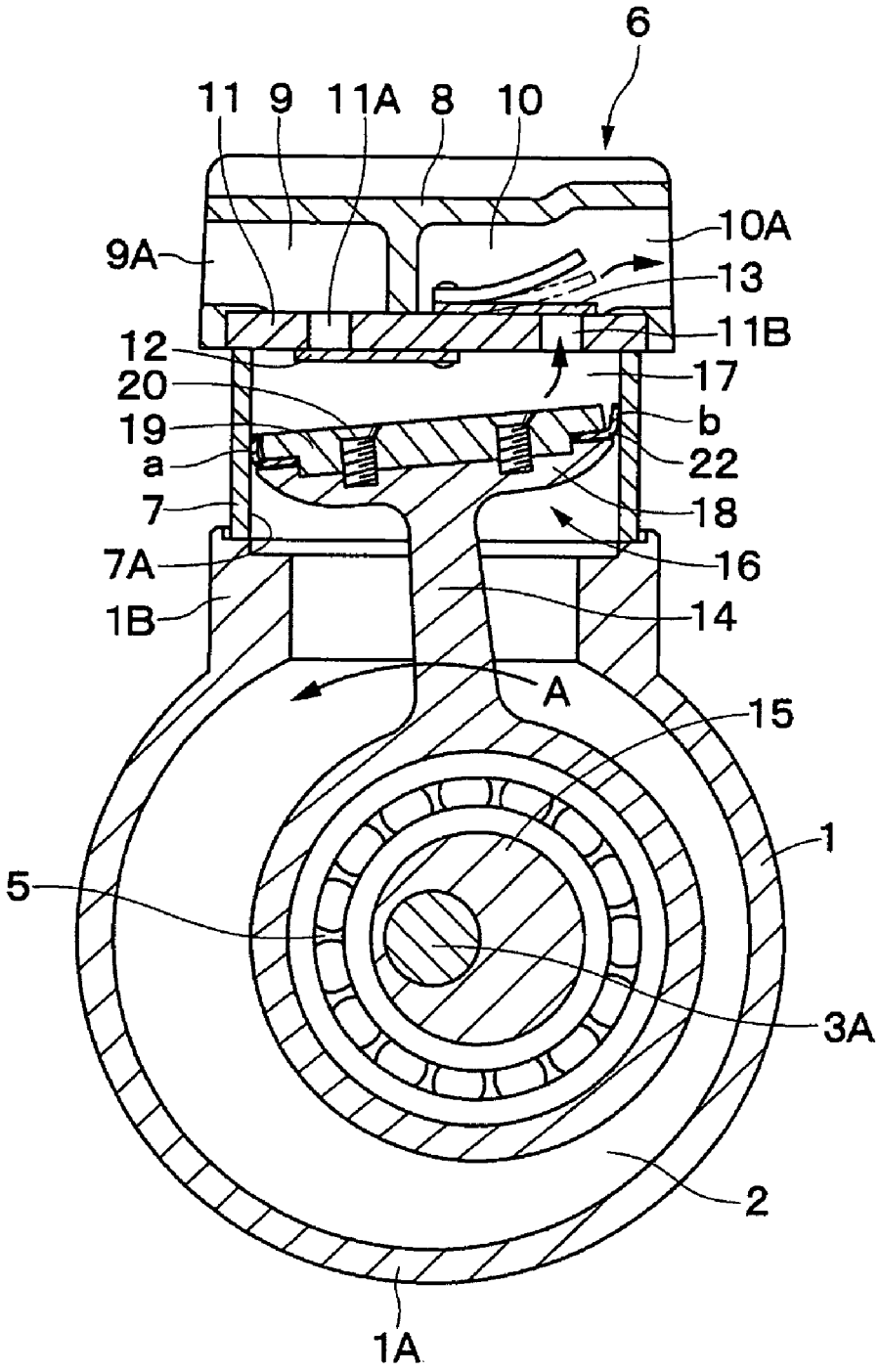
FIG. 9 is a sectional view similar to FIG. 3, showing the compression stroke of the compressing section when the motor is rotated forward.
Figure 10:
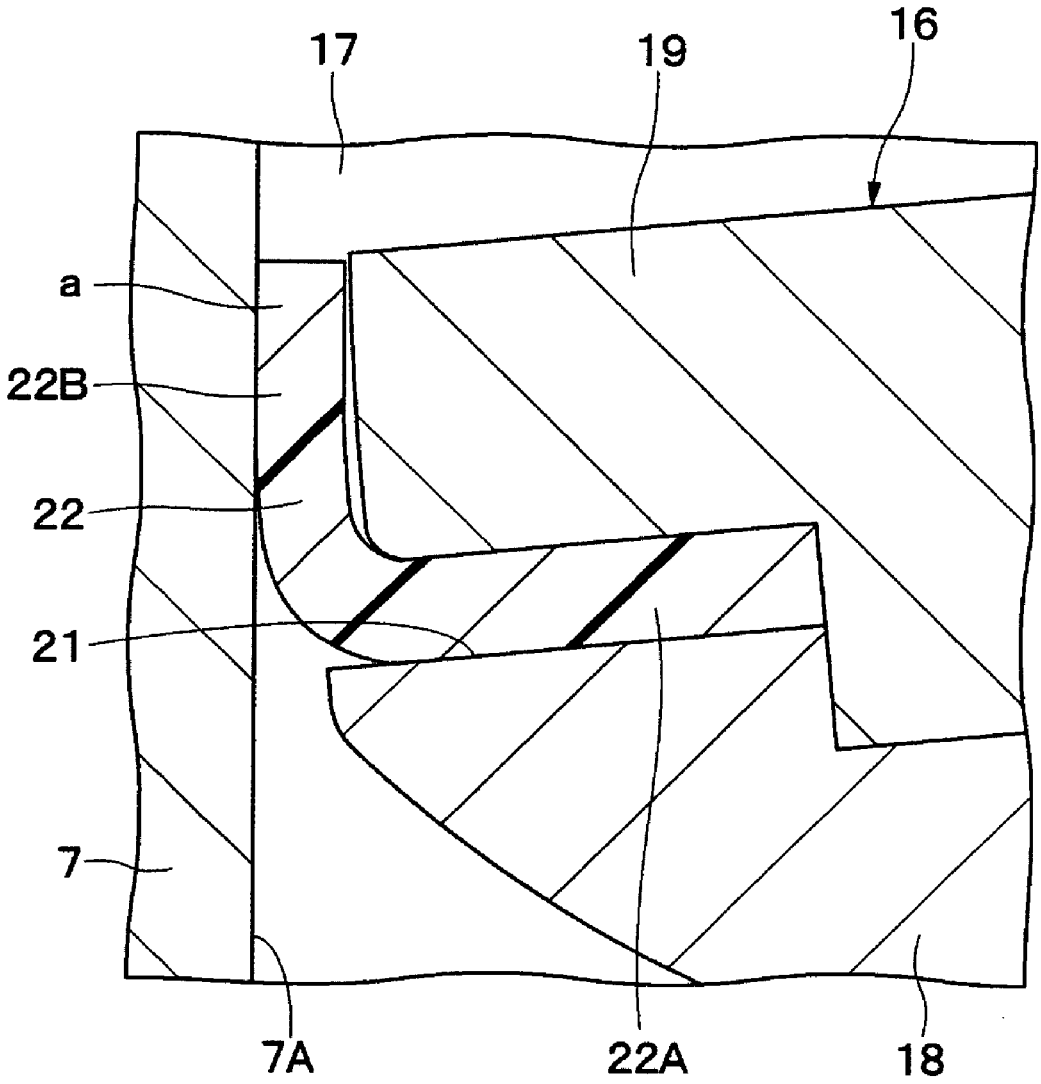
FIG. 10 is a fragmentary enlarged sectional view showing a load side region of a lip ring in FIG. 9.

When the output shaft 3A of the motor 3 is rotated forward, as shown in FIGS. 8 and 9, the crankshaft 5 rotates in the direction of the arrow A. At this time, during the suction stroke, as shown in FIG. 8, the piston 16 moves downward from the top dead center toward the bottom dead center while tilting. Consequently, the suction valve 12 opens, and outside air is sucked into the compression chamber 17.

During the compression stroke (discharge stroke), as shown in FIG. 9, the piston 16 moves upward from the bottom dead center toward the top dead center while tilting in a direction opposite to the direction in which it tilts when moving downward. Thus, the air in the compression chamber 17 is compressed, causing the discharge valve 13 to open. Accordingly, the compressed air is discharged toward the tank 23 through the discharge opening 10A.

During this operation, the oscillating type piston 16 reciprocates in the cylinder 7 while oscillating in a predetermined direction because the crankshaft 5 is eccentrically connected to the output shaft 3A of the motor 3. Further, the lip ring 22 is secured to the piston 16. Accordingly, regions a and b of the lip portion 22B of the lip ring 22 at two opposite ends thereof in the oscillation direction of the piston 16 are strongly pressed against the inner peripheral surface 7A of the cylinder 7 and hence displaced to a considerable extent. More specifically, when the piston 16 moves downward from the top dead center toward the bottom dead center while tilting during the suction stroke, as shown in FIG. 8, one end region b of the lip portion 22B is strongly pressed against the inner peripheral surface 7A of the cylinder 7 and thus displaced considerably. During the compression stroke (discharge stroke), when the piston 16 moves upward from the bottom dead center toward the top dead center while tilting in the opposite direction to that during the downward movement thereof, as shown in FIG. 9, the other end region a of the lip portion 22B is strongly pressed against the inner peripheral surface 7A of the cylinder 7 and hence displaced considerably. During the compression stroke, in particular, the pressure in the compression chamber 17 becomes high, so that the piston 16 and the lip ring 22 are subjected to a large load. Therefore, during the compression stroke, the end region a of the lip portion 22B is subjected to a larger load and displaced to a larger extent. Accordingly, of the two regions of the lip ring 22 at two opposite ends in the oscillation direction of the piston 16, the region a that is displaced to a larger extent during the compression stroke until the top dead center is reached serves as a load side region, while the other region b serves as a counter-load region. As a result, during forward rotation of the motor 3, uneven or partial wear tends to occur concentratedly at the load side region a (see FIG. 10) of the lip ring 22, whereas no substantial wear occurs at the counter-load side region b of the lip ring 22.

Figure 14:
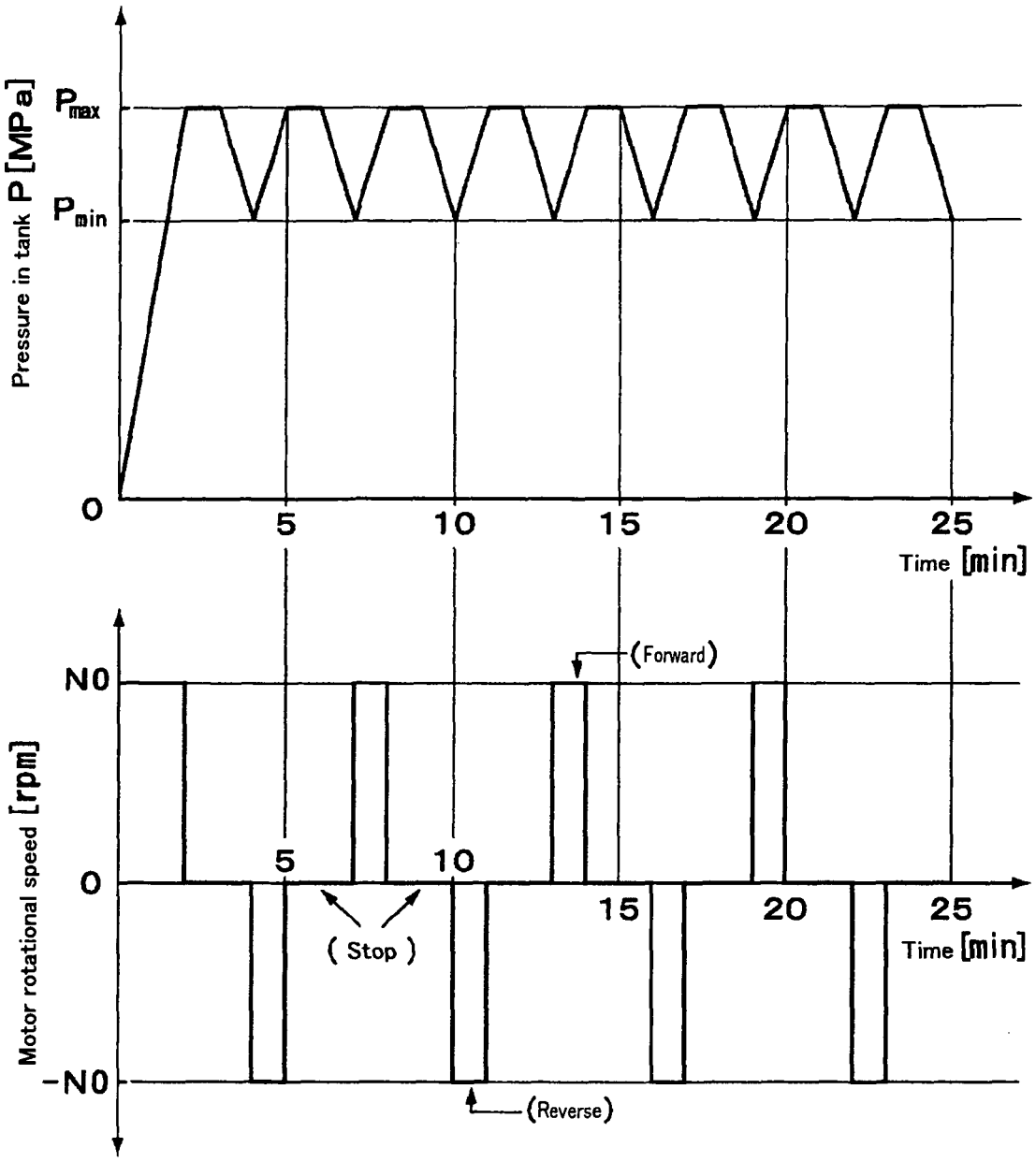
FIG. 14 is a characteristic diagram showing changes with time of pressure, rotational speed and rotation direction when an intermittent operation is performed by using the oscillating type compressor according to the first embodiment.

In this regard, the oscillating type compressor of this embodiment switches between forward and reverse rotations of the motor 3 every time the compressor is started during an operation in which the compressor repeats operation and stop intermittently according to the pressure P in the tank 23 (during an intermittent operation). That is, as shown in FIG. 14, when the pressure P in the tank 23 reaches the maximum value $P_{max}$, the operation of the compressor is stopped, and when the pressure P reaches the minimum value $P_{min}$ as a result of using the compressed air in the tank 23, the operation of the compressor is resumed.

Figure 15:
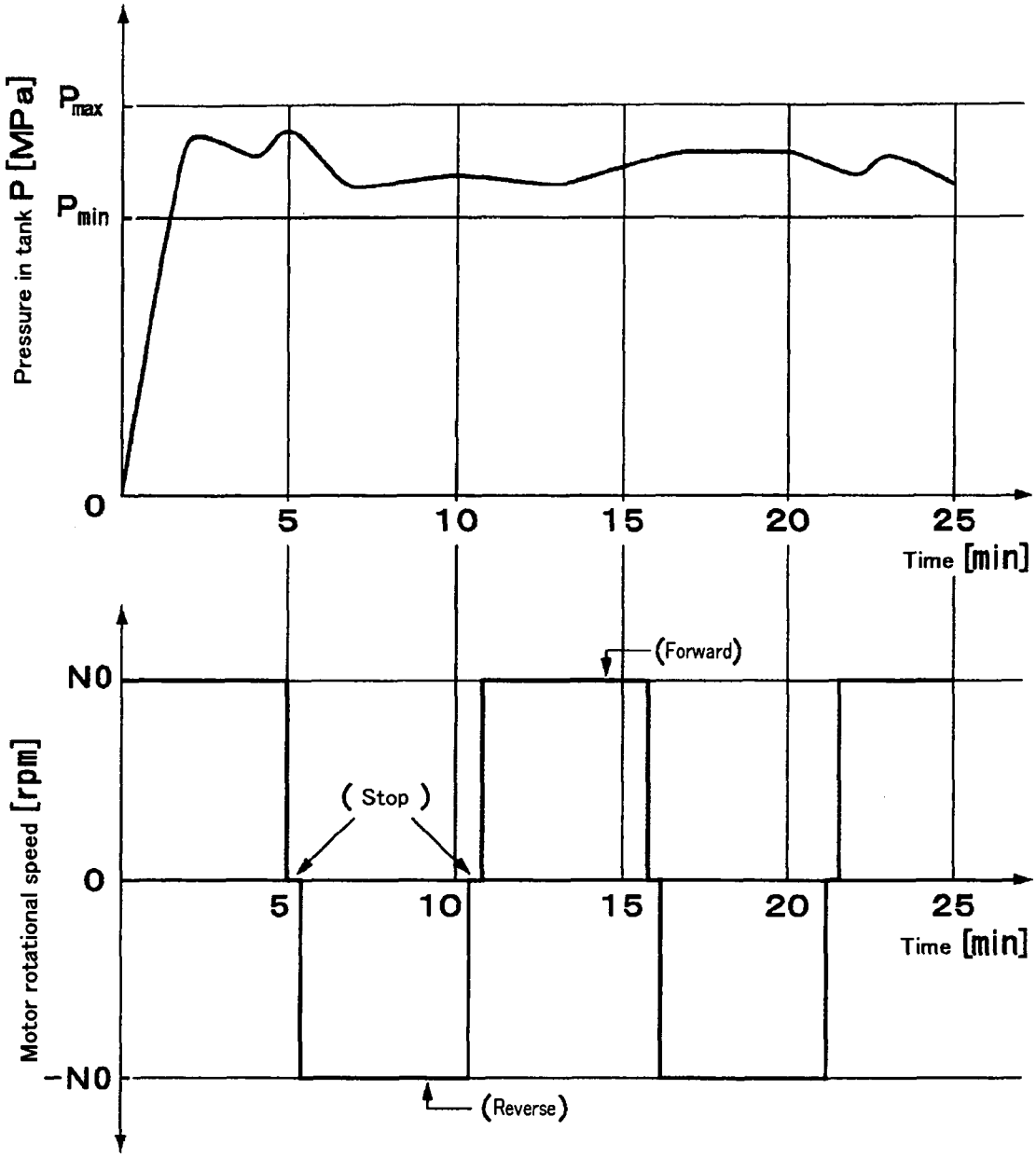
FIG. 15 is a characteristic diagram showing changes with time of pressure, rotational speed and rotation direction when a continuous operation is performed by using the oscillating type compressor according to the first embodiment.

When, for example, a pneumatic device that is connected to the tank 23 uses a large amount of compressed air and the compressor operates continuously for a long period of time (e.g. several minutes to several hours), i.e. during a continuous operation, as shown in FIG. 15, the motor 3 is switched between forward rotation and reverse rotation every predetermined period of time $T_0$, e.g. about 5 minutes.

Figure 11:
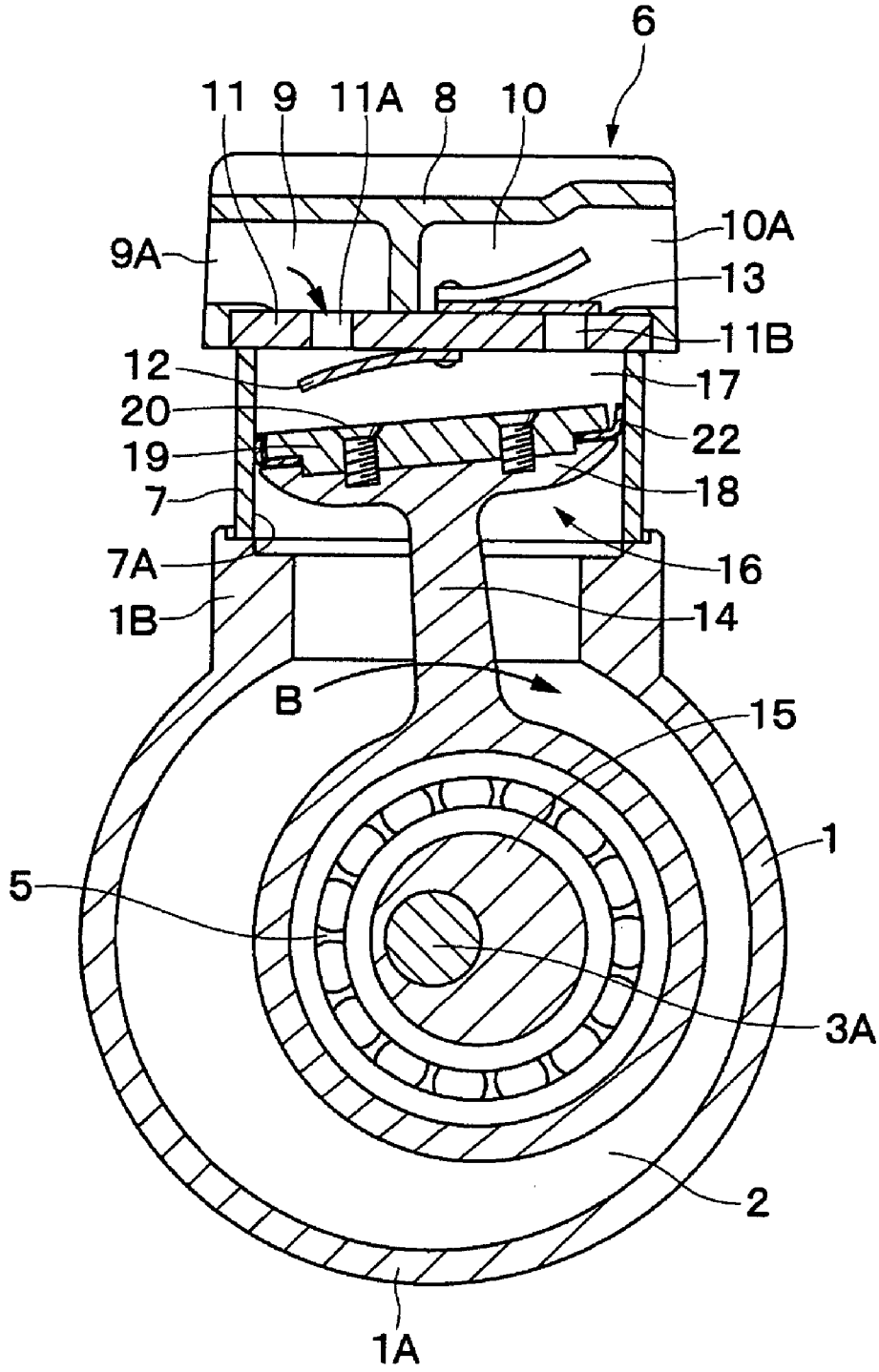
FIG. 11 is a sectional view similar to FIG. 3, showing the suction stroke of the compressing section when the motor is rotated reversely.
Figure 12:
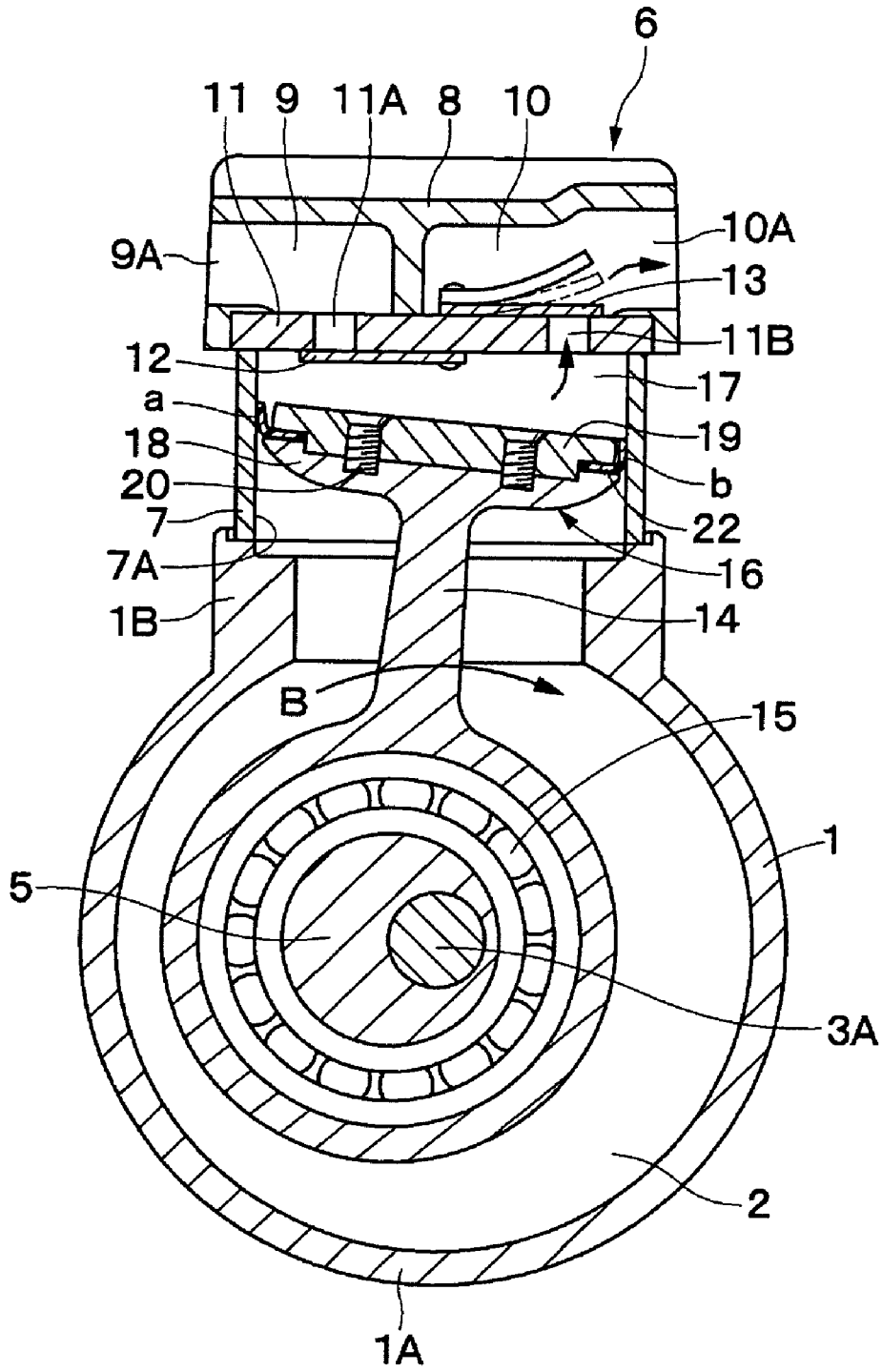
FIG. 12 is a sectional view similar to FIG. 3, showing the compression stroke of the compressing section when the motor is rotated reversely.
Figure 13:
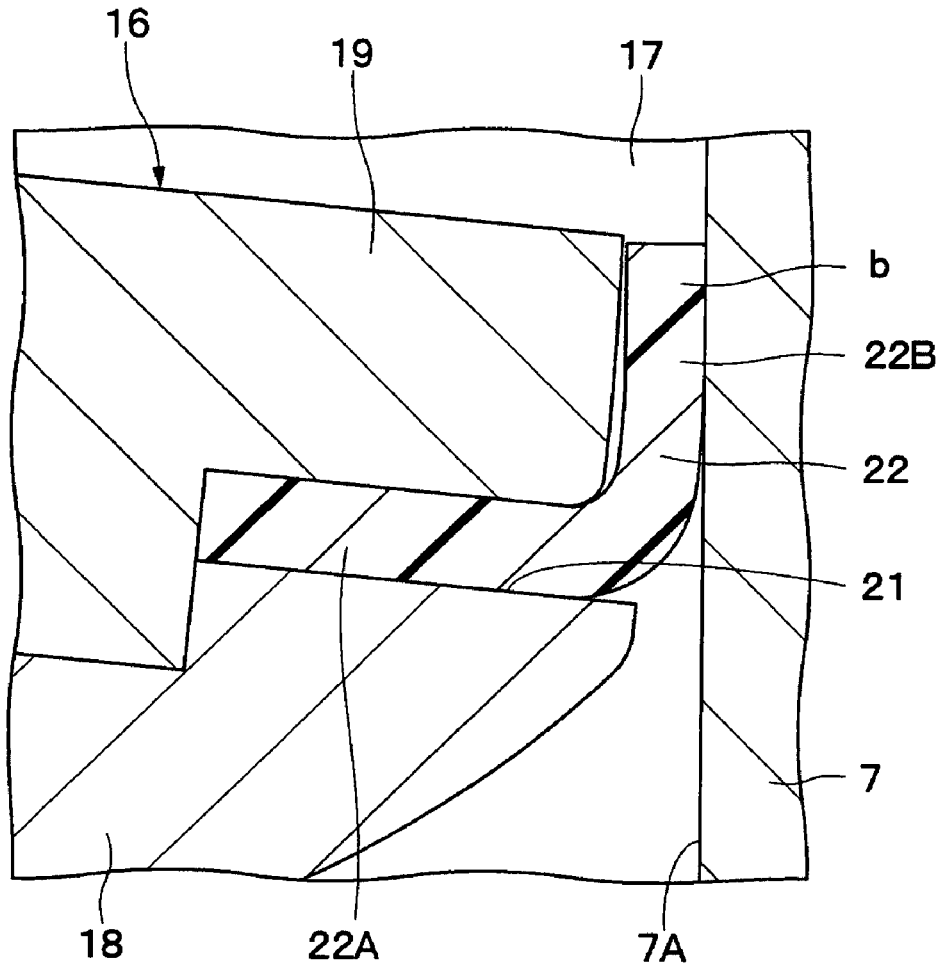
FIG. 13 is a fragmentary enlarged sectional view showing a load side region of the lip ring in FIG. 12.

Consequently, the rotation of the output shaft 3A of the motor 3 is switched over from forward rotation to reverse rotation. When the output shaft 3A of the motor 3 is reversed, as shown in FIGS. 11 and 12, the crankshaft 5 rotates in the direction of the arrow B. At this time, during the suction stroke, the piston 16 moves downward from the top dead center toward the bottom dead center while tilting, as shown in FIG. 11, in the same way as during the forward rotation of the motor 3. The piston 16, however, tilts in the opposite direction to that during the forward rotation.

During the compression stroke, as shown in FIG. 12, the piston 16 moves upward from the bottom dead center toward the top dead center while tilting in the opposite direction to that during the downward movement thereof. At this time, the piston 16 moves upward while tilting in the opposite direction to that during the forward rotation of the motor 3. Accordingly, when the motor 3 is reversed, the positional relationship between the load side and the counter-load side of the piston 16 is reversed to that when the motor 3 is rotated forward. As a result, when the motor 3 is rotated in reverse, the counter-load side during the forward rotation of the motor 3 becomes the load side. Accordingly, uneven or partial wear occurs concentratedly at the load side region b of the lip ring 22 shown in FIG. 13.

Thus, the wear of the lip ring 22 can be evenly distributed to the opposite end sides thereof in the oscillation direction of the piston 16. Consequently, wear occurs evenly at two locations on the entire periphery of the lip portion 22B. Therefore, the service life of the lip ring 22 can be extended as compared to the related art in which wear occurs concentratedly at one part of the lip ring. More specifically, in comparison to the related art, the service life of the lip ring 22 as used in an intermittent operation, for example, can be extended from 8,000 hours to about 15,000 hours. The service life in a continuous operation can be extended from 6,500 hours to about 10,000 hours.

Thus, according to the first embodiment, the control circuit 28 can switch between an operation mode in which the output shaft 3A of the motor 3 is rotated forward to perform a compressing operation, and an operation mode in which the output shaft 3A of the motor 3 is rotated reversely to perform a compressing operation. Therefore, of the entire periphery of the lip ring 22, the region a that is located at the load side during the forward rotation of the motor 3 and the region b that is located at the load side during the reverse rotation of the motor 3 are allowed to be different from each other. Accordingly, the part of the lip ring 22 that is strongly pressed against the inner peripheral surface of the cylinder 7 can be distributed to two locations. Consequently, it is possible to prevent wear from occurring concentratedly at one part of the lip ring 22 and hence possible to extend the service life of the lip ring 22.

In addition, the control circuit 28 is adapted to switch over the direction of rotation of the output shaft 3A of the motor 3 when the motor 3 is restarted after it has been stopped. Accordingly, when the compressor is operated intermittently so that the pressure P in the tank 23 falls between the maximum value $P_{max}$ and the minimum value $P_{min}$, rotation direction switching control for the motor 3 can be performed together with the stop-start control for the motor 3. Therefore, the rotation direction switching control for the motor 3 can be performed by utilizing a detected signal from the pressure sensor 24, which has heretofore been used, without the need to provide an extra detecting device or the like.

Further, the control circuit 28 is adapted to switch over the rotation direction of the output shaft 3A of the motor 3 when the motor 3 has been driven continuously for a predetermined period of time. Therefore, even when the compressor is operated continuously without stopping, the load side position on the lip ring 22 can be distributed to two opposite ends in the oscillation direction of the piston 16. Accordingly, even when the lip ring 22 is likely to become worn by heat of compression or frictional heat in a continuous operation, it is possible to prevent wear from occurring concentratedly at one part of the lip ring 22 and hence possible to extend the service life of the lip ring 22.

Further, the control circuit 28 is adapted to pause for a predetermined period of time before switching over the rotation direction of the output shaft 3A of the motor 3. Therefore, even when the rotation direction of the motor 3 is switched over immediately after the compressor has been stopped, the compressor can be driven without causing short-circuiting or troubles due to counter electromotive force.

Figure 16:
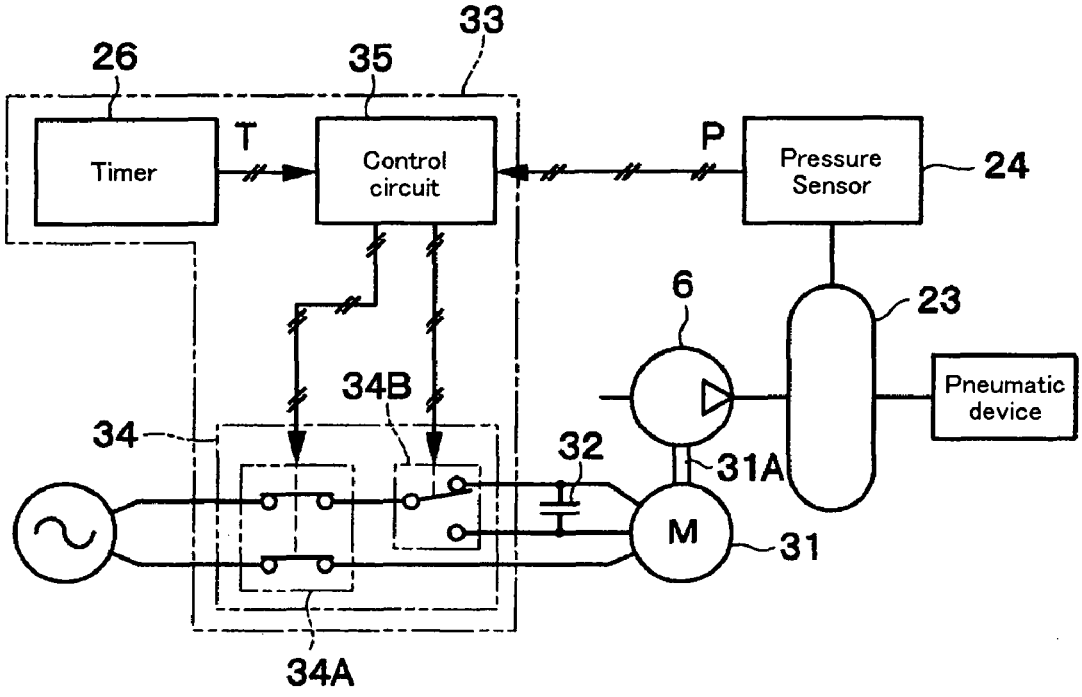
FIG. 16 is a circuit diagram showing a switching circuit of an oscillating type compressor according to a second embodiment of the present invention.

FIG. 16 shows a second embodiment of the present invention. The feature of this embodiment resides in that a single-phase induction motor is used as the electric motor. It should be noted that in the second embodiment the same constituent elements as those in the foregoing first embodiment are denoted by the same reference symbols as those used in the first embodiment, and a description thereof is omitted.

An electric motor 31 in the second embodiment is a capacitor-start single-phase induction motor, for example, which is started by using a capacitor 32. The motor 31 rotationally drives an output shaft 31A, thereby causing the compressing section 6 to perform a compressing operation, in the same way as in the first embodiment.

A power supply section 33 is provided in connection with the motor 31. The power supply section 33 is arranged in substantially the same way as the power supply section 25 in the first embodiment. That is, the power supply section 33 has a timer 26, a switching circuit 34, and a control circuit 35.

The switching circuit 34 for switching over the direction of rotation of the motor 31 comprises a power supply switch 34A provided between the motor 31 and the power source to start or stop the power supply to the motor 31, and a change-over switch 34B that connects one phase of the power source to the starting capacitor 32 in a change-over manner.

The power supply switch 34A comprises a magnet relay, for example, and turns ON or OFF on the basis of a control signal from the control circuit 35 (described below). The change-over switch 34B also comprises a magnet relay, for example, and selectively connects one phase of the power source to either of the opposite ends of the capacitor 32 on the basis of a control signal from the control circuit 35. Thus, the change-over switch 34B switches between forward and reverse rotations of the motor 31.

The control circuit 35 serves as a controller that controls the drive of the motor 31. The control circuit 35 comprises a microcomputer, for example, and operates using substantially the same program as that used by the control circuit 28 in the first embodiment. The control circuit 35 is connected with the pressure sensor 24, the timer 26, and the switching circuit 34. The control circuit 35 controls the drive and stop of the motor 31 on the basis of a detected signal from the pressure sensor 24 and also switches over the rotation direction of the motor 31 by using the timer 26, the switching circuit 34, etc.

Thus, the second embodiment arranged as stated above also offers substantially the same advantageous effects as those of the foregoing first embodiment.

Figure 17:
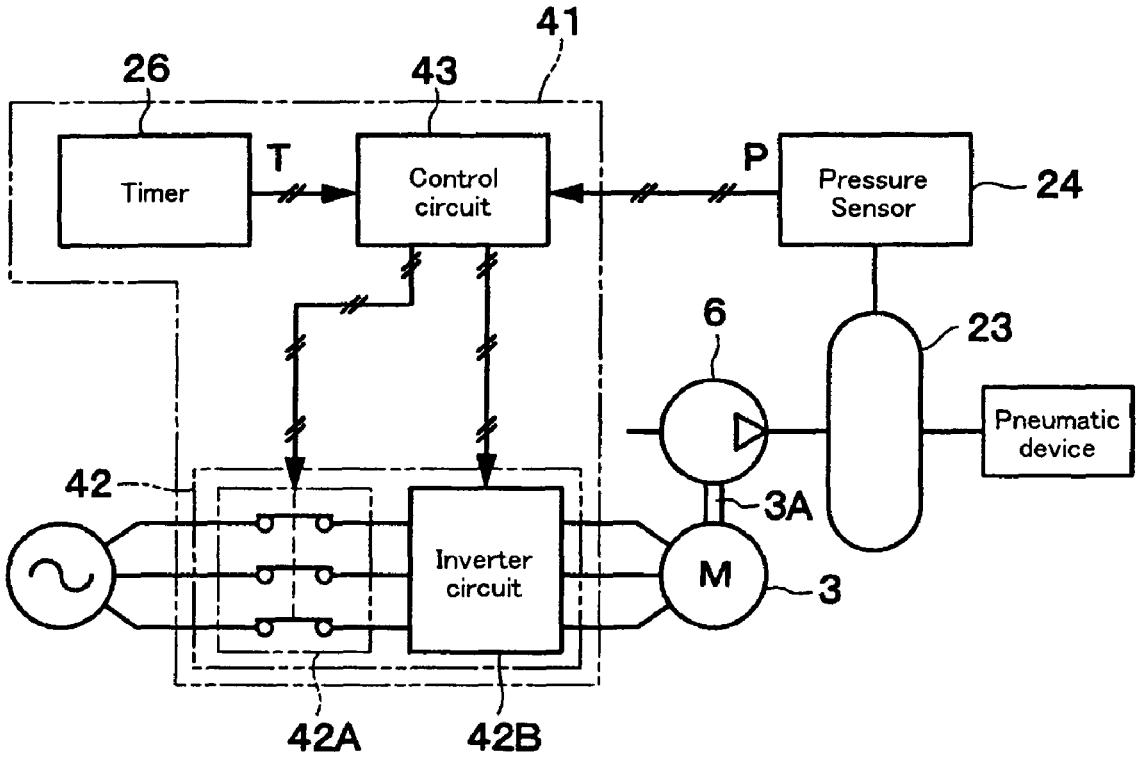
FIG. 17 is a circuit diagram showing a switching circuit of an oscillating type compressor according to a third embodiment of the present invention.
Figure 18:
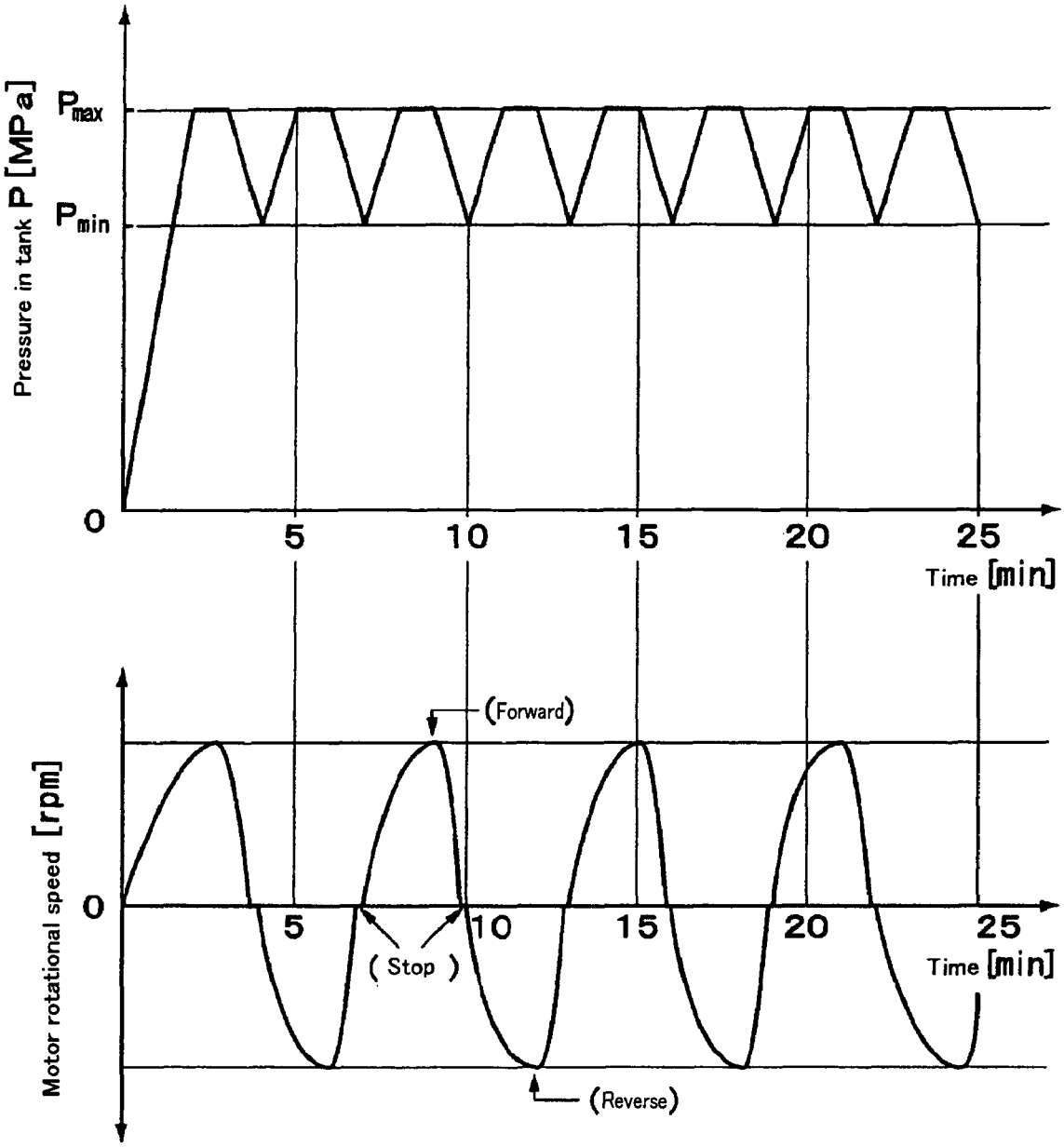
FIG. 18 is a characteristic diagram showing changes with time of pressure, rotational speed and rotation direction when an intermittent operation is performed by using the oscillating type compressor according to the third embodiment.

FIGS. 17 and 18 show a third embodiment of the present invention. The feature of this embodiment resides in that the rotational speed and rotation direction of an electric motor are controlled by using an inverter.

A power supply section 41 is provided in connection with the motor 3. The power supply section 41 is arranged in substantially the same way as the power supply section 25 in the first embodiment. That is, the power supply section 41 has a timer 26, a switching circuit 42, and a control circuit 43.

The switching circuit 42 switches over the direction of rotation of the motor 3. The switching circuit 42 comprises a power supply switch 42A provided between the motor 3 and the power source to start or stop the power supply to the motor 3, and an inverter circuit 42B that inverter-controls the current and voltage to be supplied to the motor 3.

The power supply switch 42A comprises a magnet relay, for example, and turns ON or OFF on the basis of a control signal from the control circuit 43 (described below). The inverter circuit 42B comprises a plurality of switching elements (e.g. gate turn-off thyristors, insulated gate bipolar transistors, etc.), and variably controls the current and voltage to be supplied to each phase of the motor 3 on the basis of a control signal from the control circuit 43. Thus, the inverter circuit 42B variably controls the rotational speed of the motor 3 and also switches between forward and reverse rotations of the motor 3.

The control circuit 43 serves as a controller that controls the drive of the motor 3. The control circuit 43 comprises a microcomputer, for example, and operates using substantially the same program as that used by the control circuit 28 in the first embodiment. The control circuit 43 is connected with the pressure sensor 24, the timer 26, and the switching circuit 42. The control circuit 43 variably controls the rotational speed of the motor 3 on the basis of a detected signal from the pressure sensor 24 and also switches over the rotation direction of the motor 3 by using the timer 26, the switching circuit 42, etc.

Thus, the third embodiment arranged as stated above also offers substantially the same advantageous effects as those of the foregoing first embodiment.

It should be noted that in the foregoing embodiments the cooling fan 4 for cooling the compressing section 6 is secured to the output shaft 3A (31A) of the electric motor 3 (31). The present invention, however, is not necessarily limited to the above-described structure. For example, a cooling fan that is driven independently of the motor may be provided in a case where the cooling efficiency of the compressing section lowers when the motor is reversed.

Further, in the foregoing embodiments, the output shaft 3A (31A) of the motor 3 (31) is connected directly to the crankshaft 5 that reciprocates the piston 16. The present invention, however, is not necessarily limited to the above-described structure. For example, the output shaft of the motor and the crankshaft may be connected indirectly through a pulley or the like.

Figure 19:
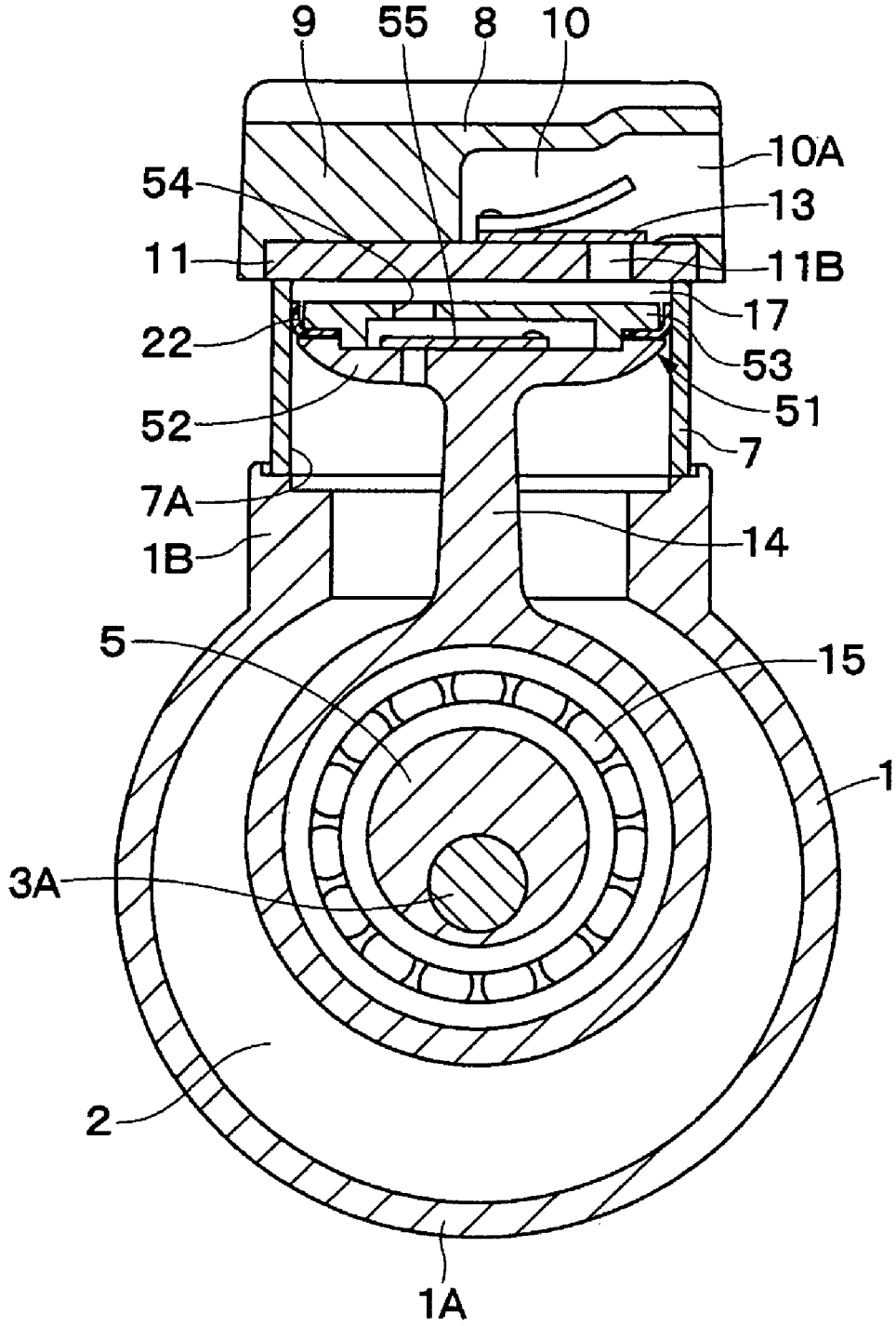
FIG. 19 is a sectional view similar to FIG. 3, showing an oscillating type compressor according to a modification of the present invention.

Further, in the foregoing embodiments, the suction hole 11A formed in the valve seat plate 11 is opened or closed with the suction valve 12. The present invention, however, is not necessarily limited to the above-described arrangement. The arrangement may, for example, be as follows. As shown in a modification of FIG. 19, a piston body 52 and a retainer 53 that constitute a piston 51 are provided with a suction hole 54 that communicates between the crank chamber 2 and the compression chamber 17, and the piston 51 is provided with a suction valve 55 that opens or closes the suction hole 54.

Further, although the foregoing embodiments use an induction motor as the motor 3 (31), other alternating-current motors, e.g. a synchronous motor, may also be used. A direct-current motor is also usable.

Further, in the foregoing embodiments, the present invention has been described with regard to an example in which air is compressed by the oscillating type compressor. The present invention, however, is not necessarily limited thereto but may be applied to compressing a refrigerant or the like, for example.

According to the above-described embodiments, the oscillating type compressor is adapted to be switchable between an operation mode in which the output shaft of the motor is rotated forward to perform a compressing operation, and an operation mode in which the output shaft of the motor is rotated reversely to perform a compressing operation. Therefore, of the entire periphery of the seal member, a region that is located at the load side during the forward rotation of the motor and a region that is located at the load side during the reverse rotation of the motor are allowed to be different from each other. In other words, during the forward rotation of the motor, the load side position on the seal member is located at one end in the oscillation direction of the piston. During the reverse rotation of the motor, the load side position on the seal member is located at the other end in the oscillation direction of the piston. Accordingly, the part of the seal member that is strongly pressed against the inner peripheral surface of the cylinder can be distributed to two locations. Consequently, it is possible to prevent wear from occurring concentratedly at one part of the seal member and hence possible to extend the service life of the seal member.

Further, according to the foregoing embodiments, the direction of rotation of the output shaft of the motor is switched over when the motor is restarted after it has been stopped. Accordingly, when the compressor is operated intermittently, for example, in such a manner that it is stopped when the pressure in the air tank is not lower than an upper limit, and when the air tank pressure is not higher than a lower limit, the compressor is started, the rotation direction switching control for the motor can be performed together with the stop-start control for the motor. Therefore, the rotation direction switching control for the motor can be performed by utilizing, for example, a signal from a pressure sensor, which has heretofore been used, without the need to provide an extra detecting device or the like.

Further, according to the foregoing embodiments, the rotation direction of the output shaft of the motor is switched over when the motor has been driven continuously for a predetermined period of time. Therefore, even when the compressor is operated continuously without stopping, the load side position on the lip ring can be distributed to two opposite ends in the oscillation direction of the piston. Accordingly, it is possible to prevent wear from occurring concentratedly at one part of the lip ring and hence possible to extend the service life of the lip ring.

Further, according to the foregoing embodiments, the rotation direction of the output shaft of the motor is switched over after a predetermined pause time. Therefore, even when the rotation direction of the motor is switched over immediately after the compressor has been stopped, for example, the compressor can be driven without causing short-circuiting or troubles due to counter electromotive force.

Although only some exemplary embodiments of this invention have been described in detail above, those skilled in the art will readily appreciate that many modifications are possible in the exemplary embodiments without materially departing from the novel teaching and advantages of this invention. Accordingly, all such modifications are intended to be included within the scope of this invention.

The entire disclosure of Japanese Patent Application No. 2006-152658 filed on May 31, 2006 including specification, claims, drawings and summary is incorporated herein by reference in its entirety.

What is claimed is:

1. An oscillating type compressor comprising:

a cylinder;

a piston connected to an output shaft of a motor to reciprocate in said cylinder while oscillating and to define a compression chamber in said cylinder;

an annular seal member provided on an outer periphery of said piston to seal between said piston and said cylinder; and a controller that controls drive of said motor, wherein said controller is switchable between an operation mode in which the output shaft of said motor is rotated forward to perform a compressing operation, and an operation mode in which the output shaft of said motor is rotated reversely to perform the compressing operation, wherein said controller switches over a direction of rotation of the output shaft of said motor when it has been driven continuously for a first predetermined period of time.

2. The oscillating type compressor of claim 1, wherein said controller switches over the direction of rotation of the output shaft of said motor when it is restarted after being stopped.

3. The oscillating type compressor of claim 1, wherein said controller pauses for a second predetermined period of time before switching over the direction of rotation of the output shaft of said motor.

4. The oscillating type compressor of claim 2, wherein said controller pauses for a second predetermined period of time before switching over the direction of rotation of the output shaft of said motor.

5. A method of controlling an oscillating type compressor having a cylinder, a piston connected to an output shaft of a motor to reciprocate in said cylinder while oscillating and to define a compression chamber in said cylinder, an annular seal member provided on an outer periphery of said piston to seal between said piston and said cylinder, and a controller that controls drive of said motor, wherein said controller is switchable between an operation mode in which the output shaft of said motor is rotated forward to perform a compressing operation, and an operation mode in which the output shaft of said motor is rotated reversely to perform the compressing operation; said method comprising:

a step of detecting a pressure in a tank storing compressed air discharged from said oscillating type compressor;

a judging step of judging whether or not the pressure in said tank is lower than a predetermined maximum value;

a step of storing, if the pressure in said tank is judged to be not lower than the maximum value at said judging step, a direction of rotation of said motor, and stopping said motor to stop the compressing operation of said compressor;

a step of driving, if the pressure in said tank is judged to be lower than a predetermined minimum value at said judging step, said motor to rotate in a direction opposite to said stored direction of rotation of said motor;

a second judging step of judging whether or not a length of time that said motor has been driven continuously in a same direction of rotation has exceeded a predetermined period of time; and a step of storing, if it is judged at said second judging step that said predetermined period of time has been exceeded, a present direction of rotation of said motor and thereafter switching over the direction of rotation of said motor.

6. A method of controlling an oscillating type compressor having a cylinder, a piston connected to an output shaft of a motor to reciprocate in said cylinder while oscillating and to define a compression chamber in said cylinder, an annular seal member provided on an outer periphery of said piston to seal between said piston and said cylinder, and a controller that controls drive of said motor, wherein said controller is switchable between an operation mode in which the output shaft of said motor is rotated forward to perform a compressing operation, and an operation mode in which the output shaft of said motor is rotated reversely to perform the compressing operation, said method comprising:

a judging step of judging whether or not a length of time that said motor has been driven continuously in a same direction of rotation has exceeded a predetermined period of time; and a step of storing, if it is judged at said judging step that said predetermined period of time has been exceeded, a present direction of rotation of said motor and thereafter switching over the direction of rotation of said motor.

* * * * *